US008769907B2

(12) United States Patent
Camber

(10) Patent No.: US 8,769,907 B2
(45) Date of Patent: Jul. 8, 2014

(54) CONSTRUCTION ELEMENTS AND METHOD OF USING AND MAKING SAME

(75) Inventor: Bruce E. Camber, New Orleans, LA (US)

(73) Assignee: Bruce E. Camber, New Orleans, LA (US)

( * ) Notice: Subject to any disclaimer, the term of this patent is extended or adjusted under 35 U.S.C. 154(b) by 462 days.

(21) Appl. No.: 12/623,180

(22) Filed: Nov. 20, 2009

(65) Prior Publication Data

US 2011/0011027 A1 Jan. 20, 2011

Related U.S. Application Data

(60) Provisional application No. 61/226,640, filed on Jul. 17, 2009.

(51) Int. Cl.
*E04H 12/00* (2006.01)
*B66C 23/04* (2006.01)

(52) U.S. Cl.
USPC ..... 52/650.1; 52/651.09; 52/650.3; 52/638; 212/348

(58) Field of Classification Search
USPC ..... 52/81.1, 81.2, 81.4, 637, 638, 648.1, 52/650.3, 651.01, 651.02, 652.1, 653.1, 52/109, 110, 121, 650.1, 651.07, 651.09; 212/294, 299, 347, 348
See application file for complete search history.

(56) References Cited

U.S. PATENT DOCUMENTS 4,557,097 A * 12/1985 Mikulas et al. ..... 52/646
4,612,750 A * 9/1986 Maistre ..... 52/638
4,633,566 A * 1/1987 Coppa ..... 29/429
4,711,062 A * 12/1987 Gwilliam et al. ..... 52/646
4,719,726 A 1/1988 Bergman
4,745,725 A * 5/1988 Onoda ..... 52/646
4,761,929 A * 8/1988 Zeigler ..... 52/646
4,829,739 A * 5/1989 Coppa ..... 52/745.2
6,076,324 A 6/2000 Daily et al.

(Continued)

FOREIGN PATENT DOCUMENTS

WO 9609447 3/1996

OTHER PUBLICATIONS

"The Billionaires' Club Construction, architecture, A Small Business School page," webpage http://smallbusinessschool.org/legacy/webapp/sbs/Billionaires/construction.jsp.h . . . , May 2007 from Jul. 2006.

*Primary Examiner* — Ryan Kwiecinski
(74) *Attorney, Agent, or Firm* — Jonathan L. Pettit; Bernard L. Kleinke; Duckor Spradling Metzger & Wynne

(57) ABSTRACT

Construction elements and methods of using and making them in a structurally strong manner are disclosed. The construction element and the method of making it may be in the form of an elongated beam, a post or other. The element may include a generally tubular open frame formed of a series of conjoined octahedral sections constructed and arranged in a side by side manner joined together by conjoined pairs of tetrahedral sections disposed intermediate the octahedral sections. Each pair of octahedral sections may be constructed and arranged such that they are conjoined together by a common member, also common with the intermediate tetrahedral sections. The method may include forming an upright structure, using at least one large construction element having a plurality of octahedral and tetrahedral sections, and positioning at least one small construction element within an opening within the sections of the large construction element and affixing thereto.

6 Claims, 5 Drawing Sheets

(56) References Cited

U.S. PATENT DOCUMENTS

| | | | | |
|---|---|---|---|---|
| 6,931,812 | B1 * | 8/2005 | Lipscomb | 52/653.1 |
| 7,318,303 | B1 * | 1/2008 | Kling | 52/648.1 |
| 7,574,832 | B1 * | 8/2009 | Lieberman | 52/118 |
| 7,963,084 | B2 * | 6/2011 | Merrifield et al. | 52/646 |
| 8,006,462 | B2 * | 8/2011 | Murphy et al. | 52/645 |
| 2001/0004823 | A1 * | 6/2001 | Cronin et al. | 52/651.01 |
| 2002/0056248 | A1 * | 5/2002 | Warren | 52/648.1 |
| 2004/0107669 | A1 * | 6/2004 | Francom | 52/697 |

* cited by examiner

CONSTRUCTION ELEMENTS AND METHOD OF USING AND MAKING SAME

RELATED APPLICATION

This application claims priority to U.S. Provisional Patent Application Ser. No. 61/226,640, which is hereby incorporated by reference in its entirety.

FIELD OF THE INVENTION

The present invention relates in general to construction elements and methods of using and making them. It more particularly relates to a construction elements and methods of using and making them to provide a structurally strong framework or member such as a beam, strut, post or other.

BACKGROUND ART

There is no admission that the background art disclosed in this section legally constitutes prior art.

There are many types and kinds of construction elements, such as beams, struts, posts, and many others. Such elements may be used for constructing buildings, for serving as construction equipment such as cranes, and many others.

Another example is a space frame or space structure which is a truss-like structure constructed of interlocking struts typically used to accomplish long spans with few supports. The typical space frame may be a horizontal slab of interlocking square pyramids built from aluminum or steel struts and utilized as a roof span. This type of frame may be conventionally used in such items as tower cranes and may also be used in the construction of modern motorcycles and automobiles.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
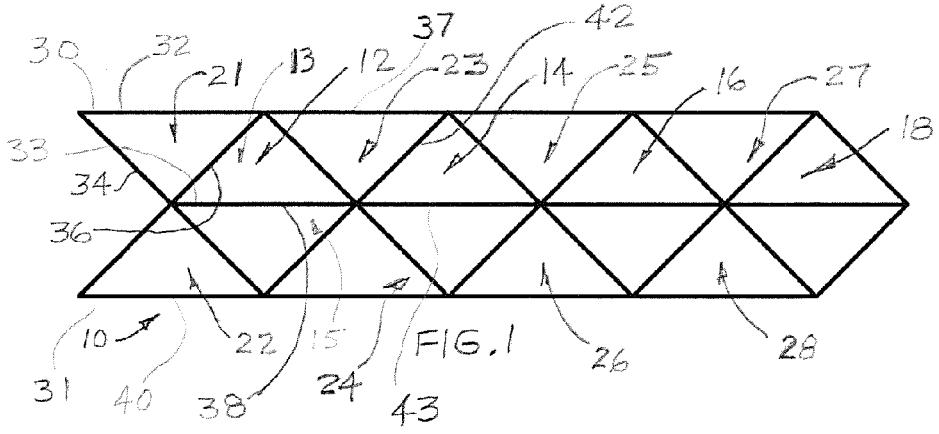
FIG. 1 is a side elevational diagrammatic view of a construction element constructed according to an embodiment of the present invention.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

There is disclosed construction elements and methods of using them in a structurally strong manner. One embodiment of the construction element may be in the form of an elongated beam, a post or other. The element may include a generally tubular rigid open frame formed of a series of conjoined octahedral sections constructed and arranged in a side by side manner joined together by conjoined pairs of tetrahedral sections disposed intermediate the octahedral sections. Each pair of octahedral sections and pairs of tetrahedral sections may be repeated along the longitudinal axis of the construction element to provide an open frame construction.

According to a further embodiment of the present invention, there is provided a construction element and a method of using and making it to build structurally strong building configurations. The construction element may be an elongated generally tubular rigid open frame formed of rodlike members. The construction element may be used in building configurations and others, and includes a series of octahedral sections conjoined together in a side by side arrangement along a longitudinal axis. Pairs of conjoined tetrahedral sections may be conjoined between adjacent octahedral sections.

The construction elements according to embodiments of the invention include octahedral sections, each of which may have a pair of conjoined square pyramids. Adjacent octahedral sections share a common rodlike member, which also serves as a common member conjoining the pairs of the conjoined tetrahedral sections. A pair of oppositely disposed elongated tetrahedral rods includes elongated rodlike members of the conjoined pairs of tetrahedral sections. A pair of oppositely disposed elongated octahedral rods includes rodlike members of the conjoined pairs of the conjoined square pyramids. Each octahedral section may include twelve rodlike members with as many as two of these twelve rodlike members being shared with adjacent octahedral sections. Each tetrahedral section may include six rodlike members, five of which being shared in common with adjacent octahedral sections. A portion of one of the tetrahedral rods may serve as a portion of each tetrahedral section. Two adjacent conjoined octahedral sections conjoined with an intermediate pair of tetrahedral sections may be constructed using a total of twenty-five rodlike members.

According to one embodiment, each octahedral section may be constructed using twelve linear rigid rodlike members forming the perimeter thereof. The two octahedral sections may be constructed and arranged such that they are joined together by a common member, which also serves as a common member fixedly connecting the two tetrahedral sections. The construction element may include a repeating alternating pattern of an octahedral section and a pair of conjoined tetrahedral sections in the form of an elongated rigid construction element. The rodlike members of the octahedral sections may all have substantially the same length. Each tetrahedral section may be constructed using six substantially equal length linear rodlike members shared in common with as many as five of the rodlike members of the octahedral sections. The length of each rodlike member of the tetrahedral sections may be substantially the same as the lengths of each one of the rodlike members of the octahedral sections.

In accordance with yet another embodiment of the present invention, there is provided a method of making a building construction. The method may include forming an upright structure such as a vertical structure using at least one large construction element having a plurality of octahedral sections and tetrahedral sections, positioning at least one small construction element within an opening within one of the sections of the large construction element, and fixing the small construction element to at least one of the rodlike members of the large construction element. Each octahedral and tetrahedral section of the large construction element may be formed using a plurality of linear rodlike members to form a structurally strong open frame.

In accordance with still another embodiment of the present invention, there is provided a method of making a construction element. The method may include conjoining a pair of open frame octahedral sections composed of rodlike members with the octrahedral sections being conjoined at a common rodlike member, conjoining a pair of open frame tetrahedral sections composed of rodlike members to the octahedral sections therebetween at the common rodlike member, and conjoining additional like pairs of conjoined octahedral sections and tetrahedral sections along a longitudinal axis to form a generally tubular elongated rigid construction element.

Among the advantages of the inventive methods and construction element relate to a structurally strong construction element, which may be relatively light in weight as compared to conventional construction elements such as heavy steel I-beams. When used in a building configuration, the upright construction elements may include convenient spaces for routing electrical wiring, heating and air conditioning ducts, plumbing and others.

It should be understood that the rodlike members of the octahedral and the tetrahedral sections may be composed of suitable materials such as steel, titanium, aluminum, composites, thermoplastic, and others. The members may be fixed together by any suitable technique such as welding, brazing, using fasteners, and others, or combinations thereof.

Referring now to FIGS. 1 through 3A of the drawings, there is shown a construction element in accordance with an embodiment of the present invention and generally referenced as 10. The construction element 10 may be in the form of an elongated beam, strut, post, joist or other, and is a generally tubular elongated rigid open frame formed by a series of octahedral sections 12, 14, 16 and 18 conjoined side by side in a row by a series of conjoined pairs of tetrahedral sections, such as tetrahedral section pairs generally indicated at 21, 22, 23, 24, 25, 26, 27 and 28 alternating with the octahedral sections in a linear manner. It is to be understood that the elongated element 10 can be of any desired length.

Each octahedral section, such as octahedral section 12, may be in the form of a pair of square pyramids conjoined together at their square bases, such as square pyramids 13, 15. Each square pyramid may include a pair of inward faces being shared with adjacent tetrahedral sections and a pair of outer faces.

The tetrahedron sections such as the sections 21 and 22 (FIG. 1) are constructed and arranged in conjoined opposed pairs. The tetrahedral section pairs 21/22, 23/24 and 25/26 alternate with the octahedral sections in a repeating pattern.

According to another embodiment of the invention, each one of the octahedral sections may be constructed of twelve linear rodlike members, such as rodlike members 29, 32, 34, 36, 38. The lengths of all of the linear members may be substantially equal. The linear rodlike members may be constructed of suitable rigid material, such as metal, wood, plastic, composite materials, or other suitable construction material. The rodlike members may be fastened together by any suitable technique, including but not limited to welding, brazing, fastening and others.

Figure 3:
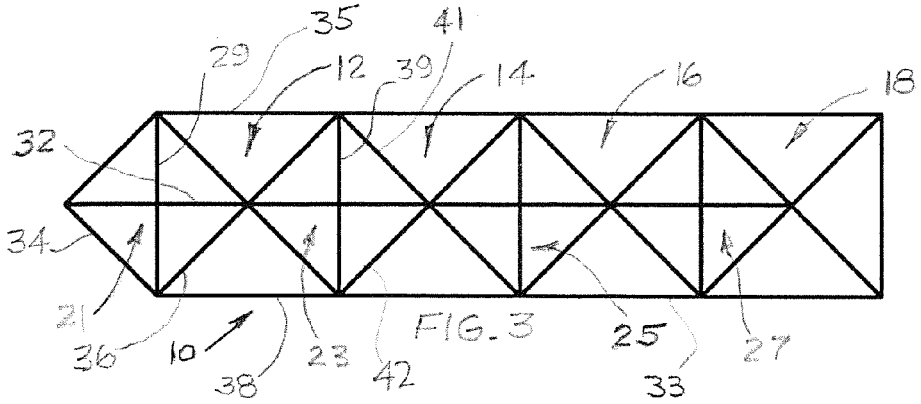
FIG. 3 is a front elevation diagrammatic view of the construction element of FIG. 1.

The octahedral sections may be aligned in a linear manner along a common longitudinal axis with adjacent octahedral sections, such as octahedral sections 12 and 14, having a shared rodlike member, such as rodlike member 39 (FIG. 3). The tetrahedral sections may be aligned in pairs, such as tetrahedral sections 21 and 22, having a shared rodlike member, such as rodlike member 29, which may also be shared by octahedral section 12, with outer rodlike members of the tetrahedral sections, such as rodlike members 32 and 40, being parallel to one another and perpendicular to the shared rodlike member, such as rodlike member 29.

Each tetrahedral section may also share four other linear rodlike members with its adjacent octahedral sections, such as and rodlike members 41 and 42 of tetrahedral section 23 being shared in common with octahedral section 14.

The outer edges of the construction element 10 in the form of pairs of oppositely disposed elongated octahedral and tetrahedral rods, such as outer edges 30 and 31 (pair of elongated tetrahedral rods), and outer edges 33 and 35 (pair elongated of octahedral rods), may be continuous longitudinal elements that extend the length of the construction element 10 and parallel to the longitudinal axis of the construction element 10. Alternatively, the outer edges may be constructed by connecting the outer rodlike members of either the octahedral or tetrahedral sections, such as outer edge 30 in the form of one of the pair of elongated tetrahedral rods may be constructed by connecting the outer rodlike members of the adjacent tetrahedral sections, such as rodlike members 32 and 37. Likewise, outer edge 33 in the form of one of the pair of elongated octahedral rods may be constructed by connecting the outer rodlike members of octahedral sections, such as rodlike members 38 and 43.

Figure 2:
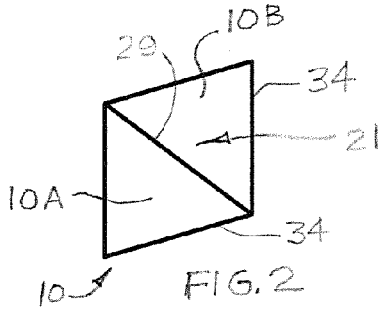
FIG. 2 is an end diagrammatic view of the construction element of FIG. 1.
Figure 3A:
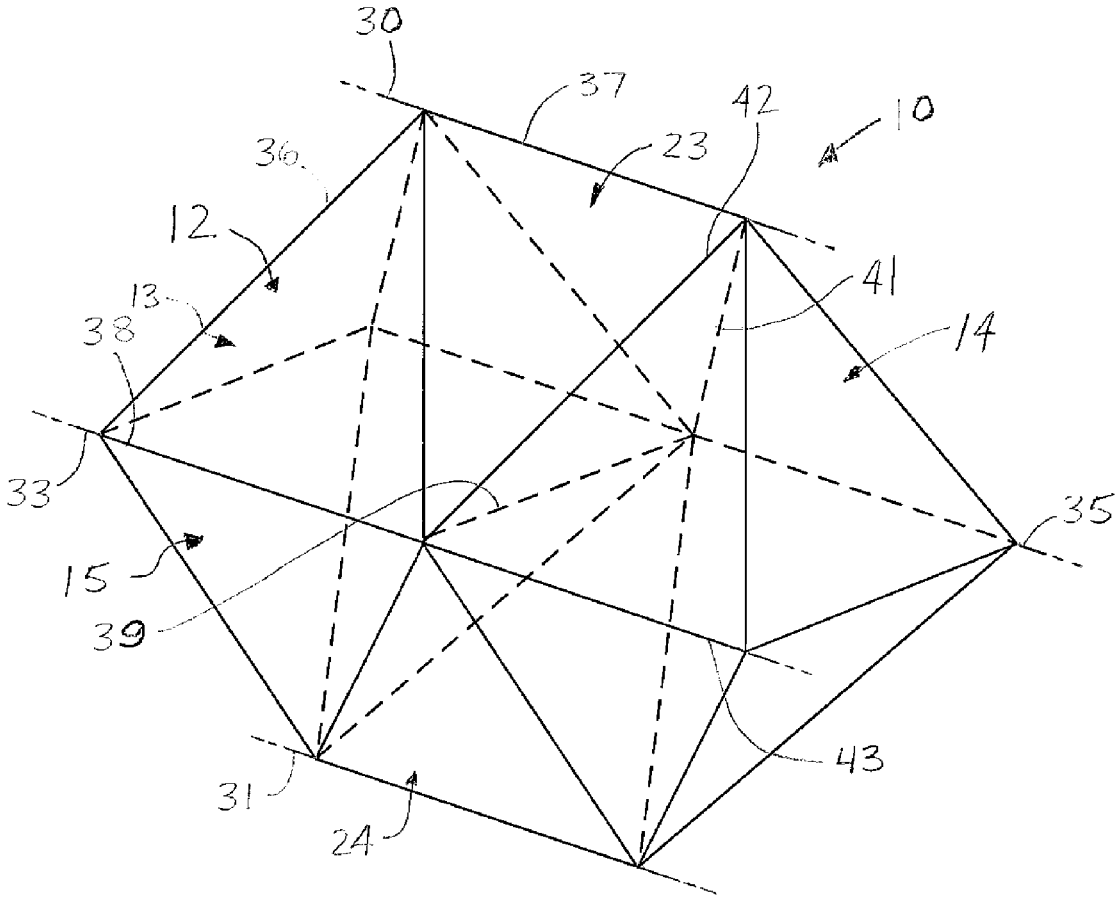
FIG. 3A is a fragmentary isometric view of the construction element of FIG. 1.

The construction element 10 may be terminated with either an octahedral section, such as octahedral section 18, or a pair of tetrahedral sections, such as tetrahedral sections 21 and 22. As seen in FIGS. 2 and 3A, the construction element 10 is trapezoidal in cross sectional shape throughout its axial length, and provides a pair of adjacent unobstructed triangular elongated spaces in the form of openings or passages 10A and 10B (FIG. 2) extending the entire axial length of the construction element 10. The spaces 10A and 10B each have a cross sectional shape in the form of triangles extending the entire axial length of the construction element 10 to receive optionally electrical wiring, heating and air conditioning ducts, plumbing and others.

Figure 4:
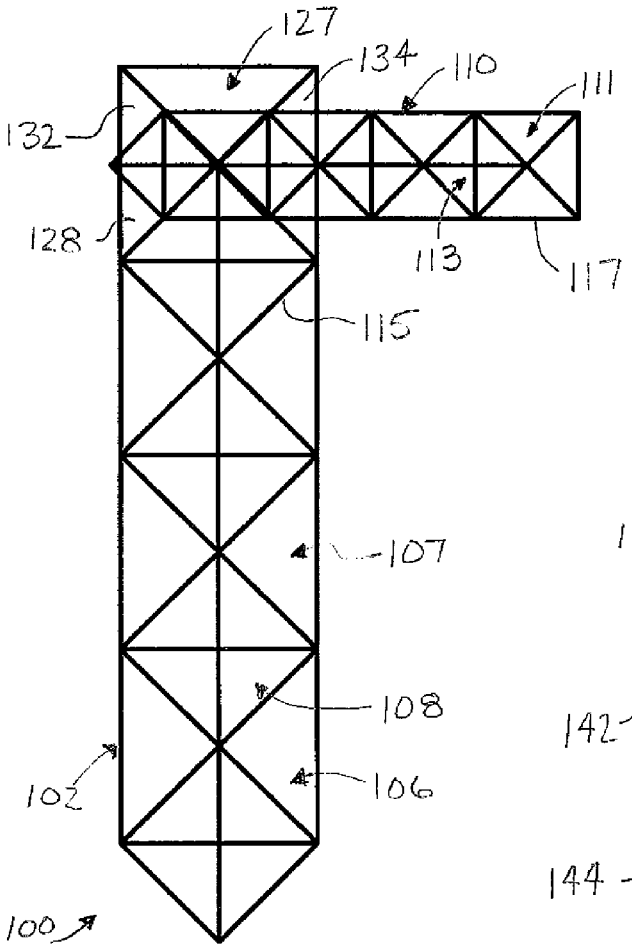
FIG. 4 is a front elevation diagrammatic view of a pair of construction elements joined together at about a right angle according to another embodiment of the invention.
Figure 5:
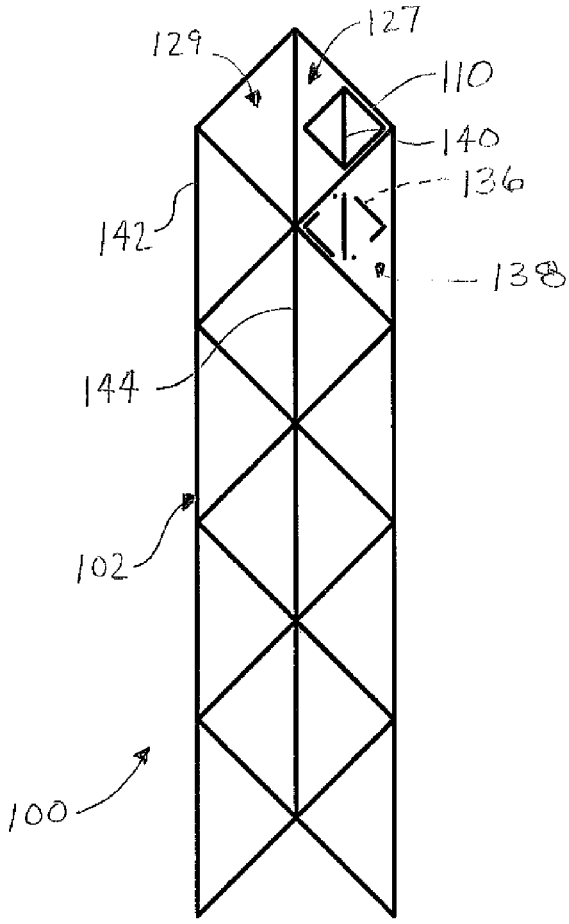
FIG. 5 is a left side elevation diagrammatic view of the pair of construction elements of FIG. 4 with an alternative location of the smaller construction element shown in phantom lines.

Referring now to FIGS. 4 and 5, according to a further embodiment of the present invention, there is shown a generally perpendicular combination of a pair of construction elements according to an embodiment of the present invention and generally referenced as 100. The generally perpendicular combination 100 may include an upright large construction element 102, which may be similar to the construction element illustrated in FIG. 3 and which may be in the form of a vertical post used to construct a building (not shown) or other. The element 102 may be composed of a plurality of alternating octahedral and tetrahedral sections, such as octahedral sections 106 and 107 joined together by a pair of tetrahedral sections including tetrahedral section 108. The combination 100 includes a horizontal small construction element 110 also composed of a plurality of alternating octahedral and tetrahedral sections, such as octahedral section 111 and tetrahedral section 113. For certain applications, the length of the rodlike members of the sections of the vertical construction element 102, such as rodlike member 115, may be greater than twice the length of the rodlike members of the sections of the horizontal construction element 110, such as rodlike member 117, to enable the horizontal construction element 110 to be properly mated with the large vertical construction element 102. Other relative dimensions may also be employed as will become apparent to those skilled in the art. In general, the small construction element 110 may be similar in construction to the construction elements 10 and/or 102, but is smaller in size than the large element 102.

To achieve the generally perpendicular relationship between the two construction elements, the horizontal construction element 110 may be positioned in, such as inserted through, or at least partially through, an opening in only one of the octahedral or tetrahedral sections, such as octahedral section 128. In fact, the horizontal construction element may be positioned in either of the square pyramids making up the octahedral section, such as square pyramids 127 and 129 of octahedral section 128. The horizontal construction element 110 may be inserted through the aligned outer faces of either of the square pyramids, such as outer faces 132 and 134 of square pyramid 127 of the octahedral section 128, with the center rodlike members of the horizontal construction element 110, such as center rodlike member 140, being parallel with the outer edges of the vertical construction element 10, such as outer edges, 142 and 144. Alternatively, a horizontal construction element 136 may be positioned, either in place of or in addition to, horizontal construction element 104 through the aligned outer faces of one of the tetrahedral sections, such as tetrahedral section 138 as shown in phantom in FIG. 5. The horizontal construction element 110 may then be attached to the vertical construction element 102 by suitable fixation (not shown) including, but not limited to, welding and/or using suitable fasteners (not shown), such as bands, clips, bolts, screws, nails, adhesive or other suitable fasteners, to attach adjacent linear members of the construction elements.

Figure 6:
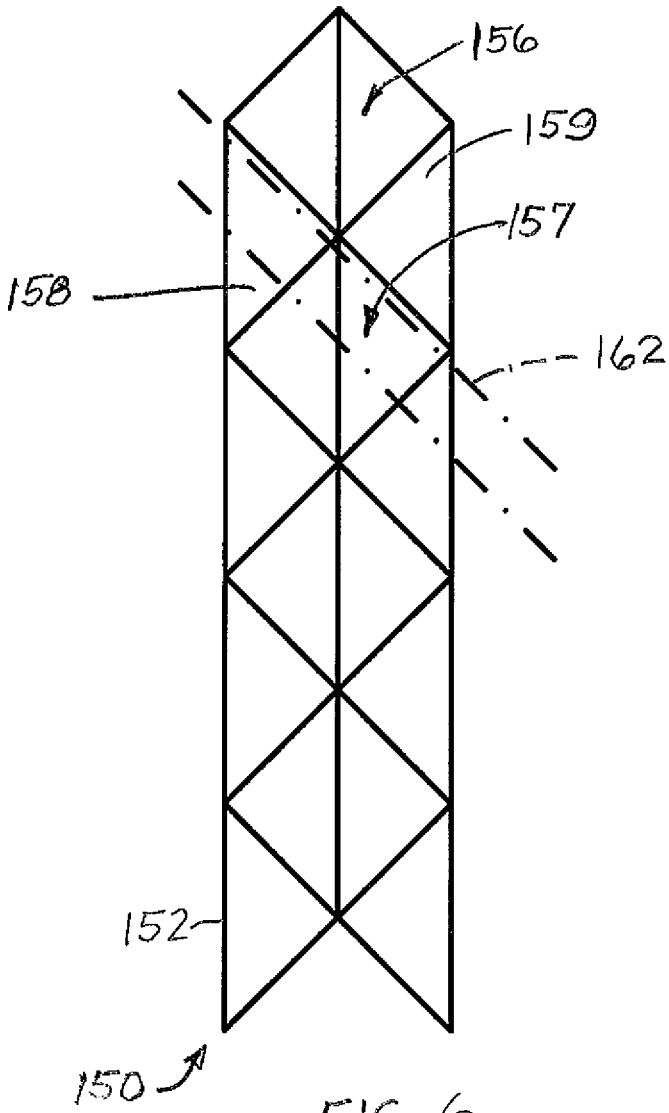
FIG. 6 is a side elevation diagrammatic view of a pair of construction elements joined together at an angle of about 45° according to a further embodiment of the invention, the small construction element being indicated in broken lines.

Referring now to FIG. 6, there is shown an angled combination of a pair of construction elements according to an embodiment of the present invention and generally referenced as 150. The angled combination 150 is similar to the combination 100, except that the angle is less than 90°. The angled combination 150 may include a large vertical construction element 152, which is similar to the element 10 of FIG. 1 and which is composed of a plurality of alternating octahedral and tetrahedral sections, such as octahedral section 156 and 157 joined together by a pair of tetrahedral sections such as tetrahedral sections 158 and 159. A small angled construction element 162 also formed of a plurality of octahedral and tetrahedral sections.

The small construction element 162 is shown diagrammatically in FIG. 6 in broken lines, and may be similar to the small construction element 110 in FIG. 4. The element 162 may be positioned in an opening in the large construction 150 to dispose the central axis of the large element 150 at an angle such as an angle of about 45° to the central axis of the small element 162.

To achieve the angled relationship between the two construction elements 150 and 162, the small angled construction element 162 may be positioned in, such as inserted through or at least partially through, one of the openings in the octahedral sections and an opening in one of the tetrahedral sections, such as the octahedral section 157 and the tetrahedral section 158 as shown in FIG. 5. The angled construction element 162 may then be attached to the vertical construction element 152 by suitable fixtures (not shown) including, but limited to, welding and/or using suitable fasteners (not shown), such as bands, clips, bolts, screws, nails, adhesive or other suitable fasteners, to attach adjacent linear members of the construction elements. The angled construction element may be inserted in and/or attached to the vertical construction element either upwardly or downwardly at an angle such as approximately a 45° angle.

Figure 7:
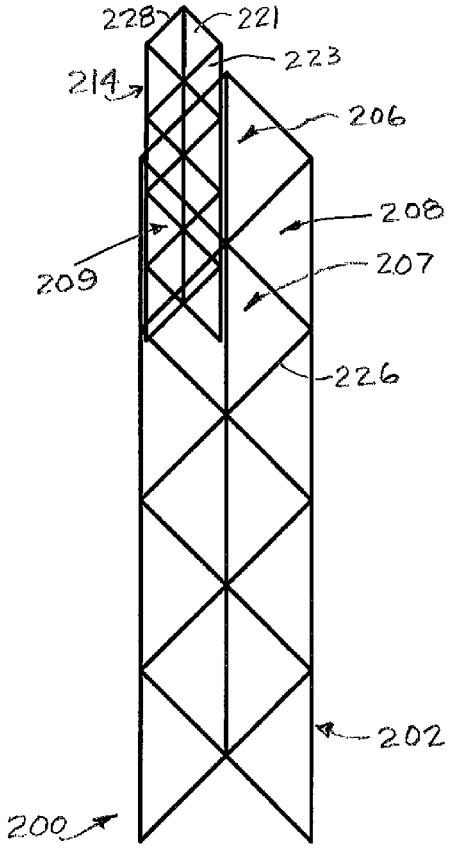
FIG. 7 is a side elevation diagrammatic view of a large construction element with a small construction element disposed telescopically therein in accordance with yet another embodiment of the invention.

Referring now to FIG. 7, there is shown an in-line combination of a pair of construction elements according to a further embodiment of the present invention and generally referenced as 200. The in-line combination 200 is similar to the combinations 100 and 150, except that the combination 200 is a telescoping arrangement where the axes of the two constructions are parallel to one another. The combination 200 may include a large upright construction element 202 composed of a plurality of alternating octahedral and tetrahedral sections, such as octahedral sections 206 and 207 joined together by a pair of tetrahedral sections such as tetrahedral sections 208 and 209. A small upright construction element 214 also formed of a plurality of octahedral and tetrahedral sections, such as octahedral section 221 and tetrahedral section 223. For certain applications, the length of the rodlike members of the sections of the large construction element 202, such as rodlike member 226, may be greater than twice the length of the rodlike members of the sections of the small construction element 214, such as rodlike member 228, to allow the small construction element 214 to be properly mated within an opening in the large vertical construction element 202.

To achieve the in-line relationship between the two construction elements, the small vertical construction element 214 may be positioned within an opening such as inserted through, or at least partially through, only one or more of the octahedral and tetrahedral sections, such as the octahedral section 206 and the tetrahedral section 209 as shown in FIG. 6. The small vertical construction element 214 may then be attached to the large vertical construction element 202 by suitable fixation including, but not limited to, welding and/or using suitable fasteners (not shown), such as bands, clips, bolts, screws, nails, adhesive or other suitable fasteners, to attach adjacent linear members of the construction elements. The small vertical construction element 214 may also be moveably supported in the large vertical construction element 202 to allow extension upwardly and/or downwardly of the small vertical construction element 214 relative to the large vertical construction element 202 or movement within the large vertical construction element 202 using hydraulics or other suitable method. For example, when the combination 200 is used as part of a building construction, the small element 214 may serve as a movable space for occupants and can be operated in a similar manner as a conventional elevator.

Figure 8:
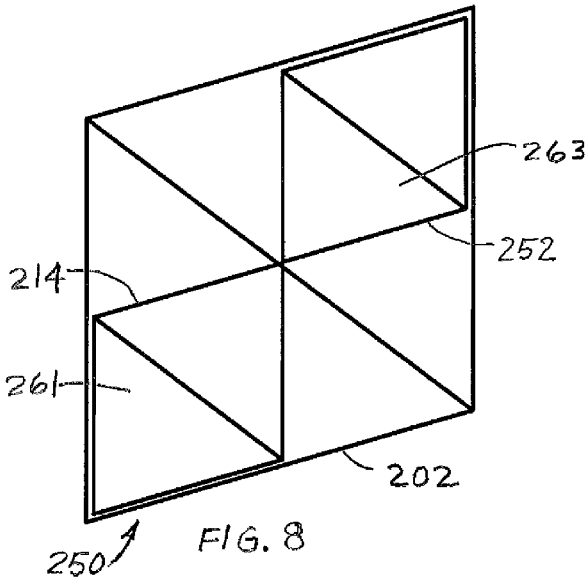
FIG. 8 is a greatly enlarged end diagrammatic view of a large construction element with a pair of small construction elements disposed telescopically therein in a similar manner as the elements of FIG. 7, in accordance with yet a further embodiment of the invention.

Referring now to FIG. 8, according to another embodiment of the present invention, there is shown an end view of another in-line combination of construction elements and generally referenced as 250. The in-line combination 250 may include the small construction element 214 and a like small element 252 positioned totally or at least partially through an unobstructed end opening in the large construction element 202. Small construction elements positioned within the large construction elements are trapezoidal in cross section throughout their length, and provide a pair of suitable elongated unobstructed triangular shaped openings or passageways such as passageways 261 and 263 extending the entire length of the respective elements 214 and 252 as shown in FIGS. 7 and 8, for receiving equipment (not shown) such as conduits for wiring, plumbing, heating/cooling/ventilation ducts or other. The inner telescoping smaller elements may add strength to the larger outer element. The small construction element has large linear members are substantially twice as long as the small linear members. The small triangular shaped openings or passageways such as passageways 261 and 263 may each receive a small construction element as clearly shown in the drawings. The large passageways each have a cross-sectional shape in the form of triangles joined together by large shared linear members and extending the entire length of the large construction element for receiving the small construction element in one of the large passageways and permitting the small construction element to extend through at least the end portion of the large construction element. The small construction element is at least partially disposed within one of the large passageways and has a pair of small adjacent triangular elongated unobstructed passageways extending the entire axial length of the small instruction element. The small construction element passageways each have a cross-sectional shape in the form of triangles extending the entire length of the small construction element. The small shared linear members extend substantially parallel to the large shared linear members and the small substantially equal size linear members converge at a point near the large shared linear members.

In order to complete a structure such as a building, a space frame, space structure, crane or other, the construction elements may be covered, either before or after construction with other construction elements, (not shown) such as with sheet metal, plywood, glass, or other suitable construction material.

While it has been described that the construction element may be fixed together by various means, it is also contemplated that the elements may be assembled together by having a small construction element extending into or through openings or voids in a large construction element, without such fixation. For example, the elements may be "pegged" together. This may provide tension release such as during earthquakes with little or no cracking or denigrating the rigid structure.

It should be understood that the orientation of the construction elements may be different than that described above depending on the desired application. It should also be understood that the words "about" and "approximately" as used herein means a tolerance of plus or minus 20 percent.

While particular embodiments of the present invention have been disclosed, it is to be understood that various different modifications are possible and are contemplated within the true spirit and scope of the present invention. There is no intention, therefore, of limitations to the exact abstract or disclosure herein presented.

What is claimed is:

1. A construction combination, comprising:

a large construction element including a conjoined pair of large octahedral sections arranged in a side by side configuration, the pair of large octahedral sections sharing a large common member;

a first conjoined pair of large tetrahedral sections disposed adjacent to the octahedral sections so constructed and arranged to join together the pair of large octahedral sections, each large tetrahedral section sharing the large common member also shared by the pair of large octahedral sections;

a second conjoined pair of large tetrahedral sections disposed adjacent to the large octahedral sections so constructed and arranged that the large octahedral sections alternate with a pair of large tetrahedral sections along the longitudinal length of the large construction element;

the cross sectional shape of the large construction element being trapezoidal extending throughout an entire axial length;

each octahedral section comprising twelve large linear members only and each large tetrahedral section comprising six large linear members only, three of said six large linear members each being shared in common with three of said large twelve members forming one of the pair of the large octahedral sections;

wherein each of the large linear members of both the large octahedral section and the large tetrahedral section have substantially the same length;

a first small construction element being substantially similar in construction relative to the large construction element, the small construction element having small linear members forming a plurality of octahedral and tetrahedral sections, the large linear members being substantially twice as long as the small linear members;

a second small construction element being of like construction relative to the first small construction element, the first and second small construction elements being positioned partially through and properly mated with an opening in the large construction element;

the large construction element including a pair of first and second adjacent triangular elongated unobstructed large passageways extending the entire axial length of the trapezoidal construction element, the pair of first and second large passageways each having a cross sectional shape in the form of triangles being joined together by large shared linear members and extending the entire axial length of the large trapezoidal construction element for receiving the small construction elements and permitting the small construction elements to extend through at least the end portion of the large construction element;

each one of the small construction elements being at least partially disposed within one of the first and second large passageways and each having a pair of small adjacent triangular elongated unobstructed equipment receiving passageways extending the entire axial length of each of the small construction elements; each one of the small equipment receiving passageways having a cross sectional shape in the form of triangles each formed by a pair of small substantially equal sized linear members joined together by small shared linear members and extending the entire length of the small construction element;

the small shared linear members of each small construction element extending substantially parallel to the large shared linear members and the small substantially equal sized linear members converging at a point near the large shared linear members;

the axes of each small construction element being disposed parallel to the central axis of the large construction element on either side thereof to add strength to the large outer construction element; and the first and second small construction elements being pegged to the large construction element to provide tension release to help prevent denigrating the structure of the construction combination.

2. The construction element according to claim 1, further including outer edges that are continuous along the longitudinal axis of the large construction element and extend the length of the construction element.

3. The construction element according to claim 2, wherein the outer edges are formed by connecting a plurality of the linear members of the octahedral section and of the tetrahedral section.

4. The construction element according to claim 2, further including a second large octahedral section, and wherein each tetrahedral section shares five of the linear members with a pair of adjacent octahedral sections.

5. The construction element according to claim 1, further including an additional large octahedral section arranged inline with the pair of octahedral sections and sharing an additional common member with one of the pair of octahedral sections.

6. The construction element according to claim 5, further including an additional pair of large tetrahedral sections to join together the additional octahedral section with the pair of octahedral sections, each of the tetrahedral sections of the additional pair of tetrahedral sections sharing the additional common member.

* * * * *